United States Patent [19]

Fuss et al.

[11] Patent Number: 4,579,250

[45] Date of Patent: Apr. 1, 1986

[54] CONE DISPENSING PACKAGE, ASSEMBLY AND METHOD

[75] Inventors: Gunter G. Fuss, San Carlos; Lorne R. Stanley, Hillsborough, both of Calif.

[73] Assignee: Safe-T-Pacific, Redwood City, Calif.

[21] Appl. No.: 19,593

[22] Filed: Mar. 12, 1979

[51] Int. Cl.[4] ..... A47F 1/08; B65G 59/06

[52] U.S. Cl. ..... 221/1; 53/451; 221/197; 221/302

[58] Field of Search ..... 221/1, 197, 287, 302, 221/307–310, 305; 53/450, 451; 229/48 T, 62; 220/458, 461

[56] References Cited

U.S. PATENT DOCUMENTS

| | | | |
|---|---|---|---|
| 2,257,823 | 10/1941 | Stokes | 53/451 X |
| 3,118,565 | 1/1964 | Chappory | 221/305 X |
| 3,365,100 | 1/1968 | Piazze | 221/307 X |
| 3,426,499 | 2/1969 | Paige | 53/451 |
| 3,935,048 | 1/1976 | Rucker | 53/451 X |
| 4,079,858 | 3/1978 | Fuss | 221/1 |

*Primary Examiner*—F. J. Bartuska
*Attorney, Agent, or Firm*—Flehr, Hohbach, Test, Albritton, & Herbert

[57] ABSTRACT

A dispensing package, assembly and method for protectively transporting, storing and dispensing stacked nested food items subject to moisture deterioration, contamination and/or staling such as ice cream cones, cups and the like. The dispensing package is composed of a stack of nested items enclosed within an elongate packaging container formed of a relatively stiff but compliant laminate material (at least one paper layer and plastic layer) which is joined and sealed along one side to form a stiff but easily tearable integral elongate ridge member extending the length and projecting out from the package. The dispensing assembly includes the package in combination with an elongate cylindrical open-ended container wherein the extending elongate ridge of the package is received in such fashion as to maintain the package in dispensing position. The readily tearable nature of the ridge member along the length and at the bottom of the package facilitates opening of a lower end of the package for exposure and dispensing of the stacked nested food items. The packaging method includes the steps of wrapping the stack of nested items within the stiff compliant laminate material and simultaneously crimping and heat sealing the edges of the laminate material to form the elongate projecting ridge member and also the crimping and heat sealing of the ends of the package.

7 Claims, 9 Drawing Figures

CONE DISPENSING PACKAGE, ASSEMBLY AND METHOD

BACKGROUND OF THE INVENTION

The present invention relates generally to packaging techniques for storing and dispensing nested articles such as ice-cream cones, cups and like food items subject to moisture deterioration, contamination and/or staling, and more particularly to a specific packaging concept and cooperating assembly and method for storing and dispensing a stack of nested ice cream cones and the like which are packaged for protection against moisture deterioration, contamination and/or staling.

In applicant's U.S. Pat. No. 4,079,858, granted Mar. 21, 1978, an article holder dispensing assembly is disclosed and provides for storing and dispensing nested articles such as ice cream cones or cups, foam insulated cups, or the like, and makes use of an elongate hollow cylindrical tube having a closed top end and open article-dispensing bottom end including clip means to releasably retain the articles within the container.

While the described dispenser assembly is quite satisfactory for storing nested drinking cups and similar non-edible articles, certain problems are encountered when the assembly is used for storing baked ice cream cones, cups and similar food items, particularly for long periods of time. Specifically, applicant has found that because the edible articles are placed within the assembly container in a totally exposed way, they are not only subject to contamination but also tend to lose desired characteristics of crispness and freshness due to moisture deterioration and/or staling. However, more important is the fact that the packages previously used with this dispenser assembly were provided for containing the ice cream cones or siimilar food items only until the latter were to be used in the dispenser assembly. This required opening the package and emptying the ice cream cones into the dispenser assembly, not only subjecting the cones to contamination as a result of their being handled during this procedure but also to the possibility of breakage.

As will be seen hereinafter, the present invention reduces the foregoing problems in a number of ways. First and foremost, the present invention provides a unitary, self-contained package for protectively transporting stacked nested food items subject to moisture deterioration, contamination and/or staling, such as ice cream cones, cups and the like. Second, the present invention provides an overall dispensing technique including the self-contained package itself which is directly fed into the dispensing apparatus and which provides protection for the food items until the latter are dispensed from the apparatus. In this regard, although the overall package including its contained food items is generally designed as a unitary self-contained dispensing package, it is specifically designed for cooperation with dispensing apparatus.

SUMMARY OF INVENTION AND OBJECTS

A general object of the present invention, therefore, is to provide an improved unitary, self-contained package for protectively transporting and dispensing stacked nested food items subject to moisture deterioration, contamination and/or staling, such as ice cream cones, cups and the like.

A more specific object of the present invention is to provide a package container which is relatively stiff but compliant for providing structural integrity and which at the same time is moisture resistant.

Another specific object of the present invention is to provide a package container of such character which can be fed directly into cooperating apparatus and which also, is readily torn at any point along its length for exposing and dispensing the stacked nested food items.

A further object of the present invention is to provide a method of forming a unitary, self-contained package of the type just described in an uncomplicated and economical manner.

A still further object of the present invention is to provide a storing and dispensing assembly which utilizes the unitary, self-contained package as described above so that most of the nested ice cream cones or other such food items remain in their original package until they are ready for removal, thereby reducing the possibility of moisture deterioration, contamination and/or staling.

Yet a further object of the present invention is to retain the self-contained package including its packaging container within its cooperating dispensing apparatus so as not to interfere with the dispensing operation of the latter.

As will be seen hereinafter, a unitary, self-contained package for protectively transporting and dispensing stacked nested ice cream cones or the like includes an elongated packaging container formed of relatively stiff but compliant laminate material, for example, material which is self-supporting when used as a package in accordance with the present invention. This material includes at least one paper layer for providing stiffness and one plastic layer laminated to the paper layer for providing moisture resistance. A plurality of stacked nested food items, for example ice cream cones, are completely enclosed within the packaging container and substantially fill the space therein. The laminate material is wrapped around the stacked items and joined along an elongate dimension thereof to provide integral elongate ridge means extending the length and projecting out from the elongate package. This ridge means has utility as retaining means within cooperating apparatus (to be described) and as readily tearable means to permit opening of a lower end of the self-contained package for exposure and dispensing of the stacked nested food items.

As will be seen hereinafter, the dispensing assembly disclosed herein includes an elongate hollow dispensing tube which may be identical to the one described in applicant's previously recited patent, and hence includes a cone dispensing opening at one end thereof. However, unlike the assembly described in that patent, the stack of nested cones is not stored in an entirely exposed manner. Instead, the nested cones are retained at all times within their original package as described above, from which only a lower end section is removed for purposes of exposing cones at the lower end of the package. These exposed cones as well as upwardly adjacent unexposed (and untouched) cones in the stack remain in a protected position within the original package, which is placed within the elongate dispensing tube so that only the endmost cones extend through the cone dispensing opening. In this way, the package itself (including the cones) can be fed directly into the dispensing tube, thereby eliminating the necessity or possibility of contamination. Moreover, the cones can be dispensed through the dispensing opening, one at a time, and hence are substantially exposed only at such time as they are ready to be dispensed, thereby reducing the possibility of moisture deterioration and staling as well as contamination.

In a preferred embodiment, the package section retained in the assembly tube (dispensing container) is maintained in a fixed position above the cone dispensing opening so as not to interfere with the actual dispensing operation. Accordingly, in this preferred embodiment, the original package containing the stack of nested cones is provided with a longitudinal ridge means extending its length as described above. In a dispensing assembly where the elongate hollow dispensing container or tube is identical to the dispensing tube described in applicant's previously cited patent, this ridge member may be folded back against the package so as to lie between the latter and the inner surace of the tube, thus providing resistance to movement of the package within the container to maintain it in fixed position. Alternatively, a section of the ridge member may be torn away from the package body and placed over the top edge of the assembly tube in order to prevent movement of the package. However, in a preferred embodiment, the container itself includes a second or upper opening at the end opposite the cone dispensing end, and a slot extending down from this second opening towards but preferably stopping short of the cone dispensing end. This slot is provided for receiving that portion of the ridge member extending the length of the package section and functions to maintain the package section in a fixed position within the container and above the cone dispensing opening.

DESCRIPTION OF THE PREFERRED EMBODIMENTS

Figure 1:
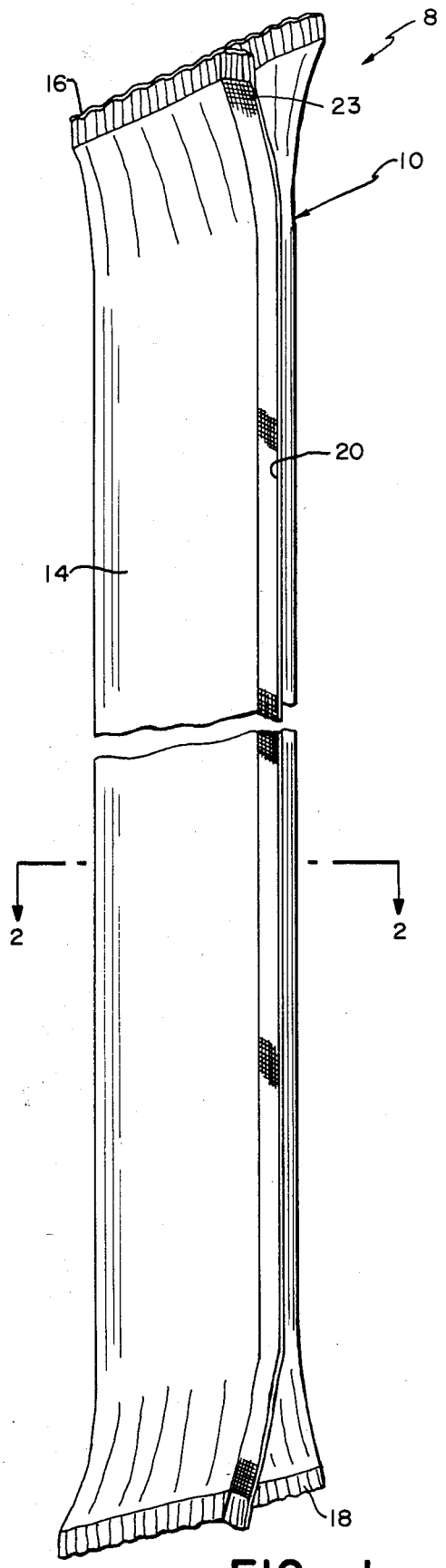
FIG. 1 is a perspective view of a unitary, self-contained package for storing and dispensing a stack of nested ice cream cones or similar edible articles, designed in accordance with the present invention.
Figure 2:
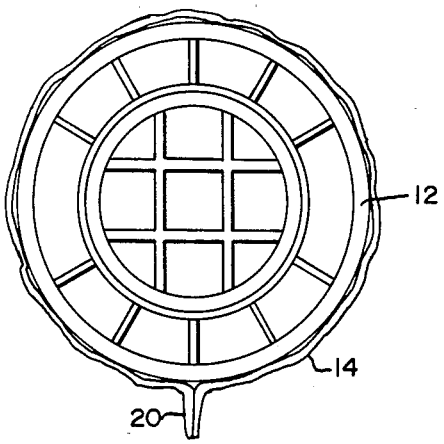
FIG. 2 is a cross-section view of the package, along the line 2—2 of FIG. 1.

FIGS. 1 and 2 show a unitary, self-contained package 8 including an elongated packaging container 10 for protectively transporting and dispensing stacked nested food 12 subject to moisture deterioration, contamination and/or staling, such as ice cream cones, cups and the like. As best seen in FIG. 1, packaging container 10 includes an elongated body 14 essentially coextensive with the stack of nested ice cream cones 12 and extending from a top sealed ridge member 16 to a bottom sealed ridge member 18. As shown, the package additionally includes a longitudinal ridge member 20 which extends the length of package 14 and which, as best seen in FIG. 2, projects out from the package body. This latter ridge member serves a number of functions. First, it acts as a seal for the package as do the top and bottom ridge members. Second, because of its double thickness (as will be discussed hereinafter) and the way in which it projects outwardly, ridge member 20 provides a certain degree of longitudinal rigidity to the package. In this regard, ridge member 20 is formed to extend normal to the top and bottom ridge members 16 and 18, so that the three cooperate to maintain body 14 in the shape illustrated. Third, the ridge member serves as readily tearable means to permit opening of a lower end of the self-contained package for exposure and dispensing of stacked nested food items at any desired point along the length of the package. Fourth, ridge member 20 serves to maintain a section of the package in a fixed position within a dispensing container which forms part of the overall cone storing and dispensing assembly 22 to be described hereinafter.

Figure 1A:
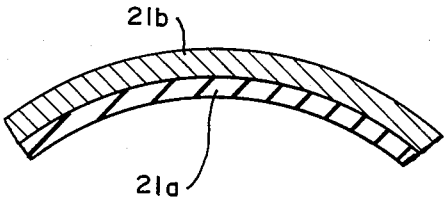
FIG. 1A is an enlarged sectional view of the package of FIG. 1 particularly illustrating the laminated construction of the package in a preferred embodiment.

The elongated packaging container 10 just described is formed of a relatively stiff but compliant laminate material including at least one paper layer for providing stiffness and one plastic layer laminated to the paper layer for providing moisture resistance. In a preferred embodiment, this laminate consists of an inner layer 21A and an outer layer 21B as shown in FIG. 1A. In this embodiment, layer 21B is Kraft Paper (bleached sulfite) weighing by industry standards between about 5 and 60 lbs for each group of 500 sheets, where the sheets are standard sheets measuring 24 inches by 36 inches (hereinafter "standard sheets"). The Kraft paper preferably weighs about 30 lbs for each 500 standard sheets. Layer 21A is a polyethylene film or coating which customarily weigh about 14.2 lbs. for each millimeter of thickness for each group of 500 standard sheets. In this embodiment, the coating is about 0.44 mils thick (about 6 lbs per 500 standard sheets).

The outer paper layer adds stiffness as well as body to the packaging container, whereas the inner plastic layer serves as a water resistant barrier. While the particular embodiment described above is preferred, it is to be understood that the package is not limited to this particular laminated arrangement, so long as the specific construction selected is compatible with the present invention. In this regard, the package could obviously include more than one paper layer and more than one plastic coating layer, although for economic reasons as well as easy tearability of the ridge member, it is desirbable to provide only the two layers described.

The overall unitary, self-contained package 10 just described, is formed in the following way in accordance with a preferred embodiment of the present invention. The ice cream cones or other food items 12 are nested together to from an elongated stack. A section of the previously described laminated material is formed to dimensions providing a surface area equivalent to but somewhat greater than a cylinder encompassing the stack of nested food items. This section of material is wrapped about the stack of nested food items and, simultaneously, its opposing edges are joined to form the previously described ridge member 20. A suitable adhesive or similar bonding means could be utilized to this end. However, in a preferred embodiment, the opposing edges are brought together by conventional apparatus sufficiently heated to melt the adjoining layers of plastic along the opposing edges. When the apparatus is removed, the melted plastic hardens and bonds the edges together to form ridge member 20. The two opposing edges are preferably formed with lateral grooves or embossments 23 when they are joined to facilitate tearing of the ridge member to permit opening of a lower end of the package for exposure and dispensing of the stacked nested food items. After formation of ridge 20, the laminated material extending outward from either end of the stack of nested food items is joined and sealed in the same manner as ridge 20 to form previously described end ridge members 16 and 18. As best seen in FIG. 1, these end ridge members are formed normal to the longitudinal ridge member 20. This transverse configuration aids in retaining the somewhat cylindrical shape of the packaging container.

Figure 3:
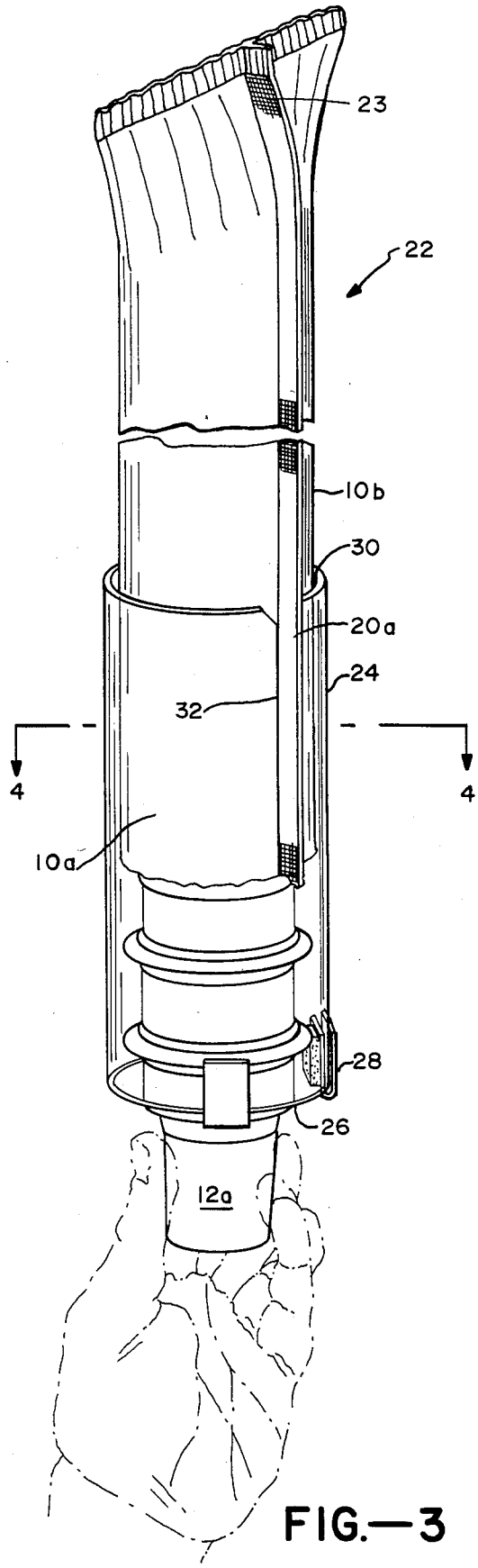
FIG. 3 is a perspective view of a cooperative assembly for storing and dispensing stacks of nested ice cream cones or the like, from within a package as in FIG. 1.
Figure 5:
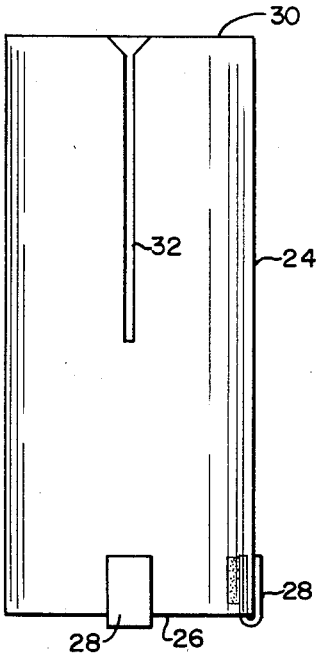
FIG. 5 is a side elevational view of a dispensing tube or container, comprising part of the assembly of FIG. 3.

Turning specifically to FIGS. 3 and 5, attention is directed to assembly 22 which serves to store and readily dispense a stack of nested ice cream cones 12. This assembly includes an elongate hollow cylindrical tube or container 24 which, except as described below, may be identical to the dispensing container described in applicant's previously recited patent. Accordingly, the container 24 includes a bottom cone dispensing opening 26 which may be varied in size by clip members 28 in the manner described in applicant's patent. However, unlike the container shown in the patent, the top end of container 24 is opened at 30 and includes a slot 32 extending down from opening 30 towards (but preferably stopping short of) cone dispensing opening 26. See FIG. 5.

As best seen in FIG. 3, the overall assembly 22 incorporates and functionally includes the package 8. More specifically, rather than removing all of the cones from the original package as in previous construction including applicant's recited patent, in accordance with the present invention, only an end section of the package is removed, thereby exposing only the lowermost end portion of the stack, specifically end cone **12*a* and possibly one or two cones directly above cone 12*a*. In this way the possibility that the cones will become stale and contaminated is reduced. In use, after the bottom end section is removed, the exposed cones as well as an adjacent unexposed portion of the stack of cones (and section 10*a* of packaging container 10 around this unexposed portion) are fed directly into container 24 such that the lowermost cone 12*a* extends through cone dispensing opening 26. As seen in FIG. 3, an upper portion 10*b* of packaging container 10 including sealed top ridge 16 extends beyond top opening 30** and is located outside the container. However, this is only because the dispensing tube is shown to be shorter in length than that of the entire package. The dispensing tube could be made longer than the package and a top closure (not shown) similar to the one recited in applicant's patent could be provided for closing the top end of the container.

Figure 4:
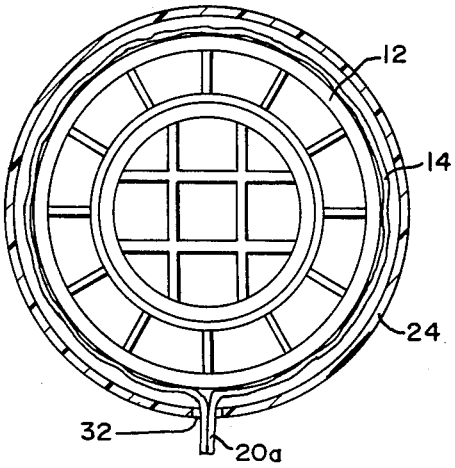
FIG. 4 is a sectional view of such assembly, along the line 4—4 of FIG. 3.

Referring to FIG. 4 in conjunction with FIG. 3, it can be seen that a portion **20*a* of the previously decribed ridge member 20 projects through the slot 32. This ridge member which extends from the lowermost end of packaging container section 10*a* upward, cooperates with container 24 (actually with the slot 32) to maintain the package sections 10*a* and 10*b* in a position within the container, and above the cone dispensing opening so as not to interfere with the cone dispensing operation. More specifically, as each cone starting with lowermost cone 12*a* is drawn out of the container, the next cone in the stack moves into the position of cone 12*a*. However, because portion 20*a* of ridge member 20 projects through the slot 32, packaging container sections 10*a* and 10*b* remain fixed relative to the container 24**, and are not drawn down towards the cone dispensing opening where they could interfere with the dispensing operation.

Figure 6:
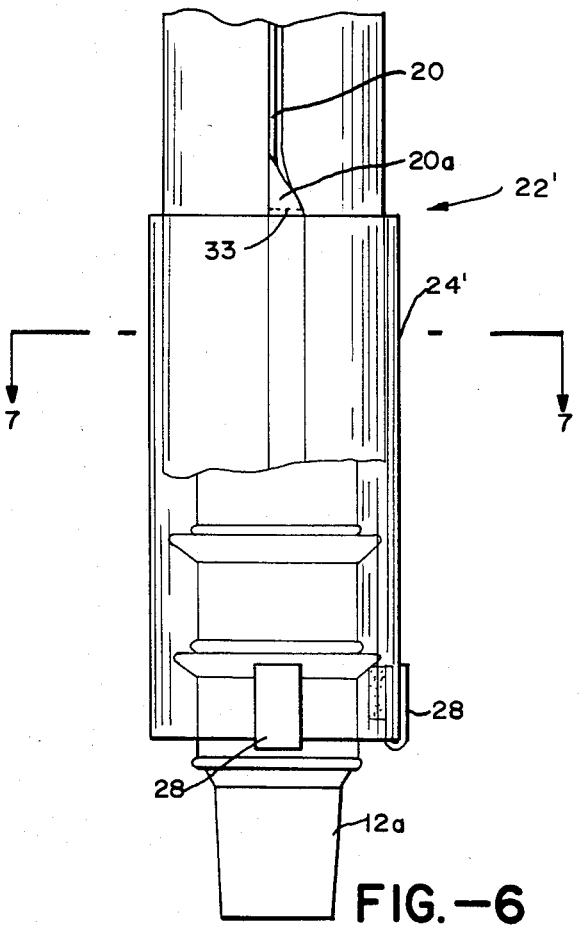
FIG. 6 is a like view of a modified cone storing and dispensing assembly.
Figure 7:
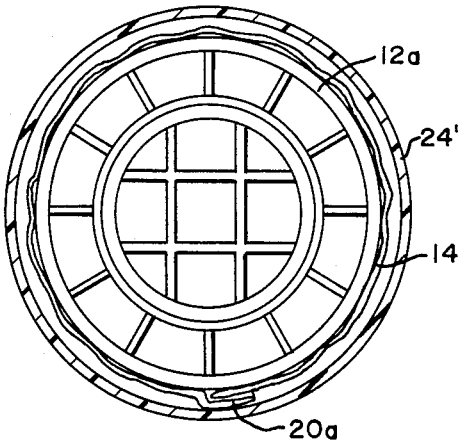
FIG. 7 is a sectional view of such modified assembly along the line 7—7 of FIG. 6.

Having described assembly 22 and the way in which ice cream cones are dispensed while retaining a section of its original package, attention is now directed to FIGS. 6 and 7 which illustrate a slightly modified assembly 22'. This assembly differs from previously described assembly 22 to the extent that its container 24' does not include the slot 32. Rather, container 24' may be identical to the container described in applicant's previously recited patent. Because container 24' does not include the slot, previously described section **20*a* of ridge member 20 must first be folded back against body 14 as best seen in FIG. 7 before or as the package section 10*a* is placed within the container. In this way, the folded back section is wedged between the package and the inner surface of the container (see FIG. 7) providing a friction fit so as to function in the same way as section 20*a* in slot 32, that is, to maintain package section 10*a*, in a fixed position within the container above opening 26. To this end, the indents 23 aid in providing a friction fit. Moreover, in order to aid in the cooperation between the package and container, ridge member 20 can be slit along dotted line 33**, that is normal to the length of the ridge member to provide a supporting shoulder.

Figure 8:
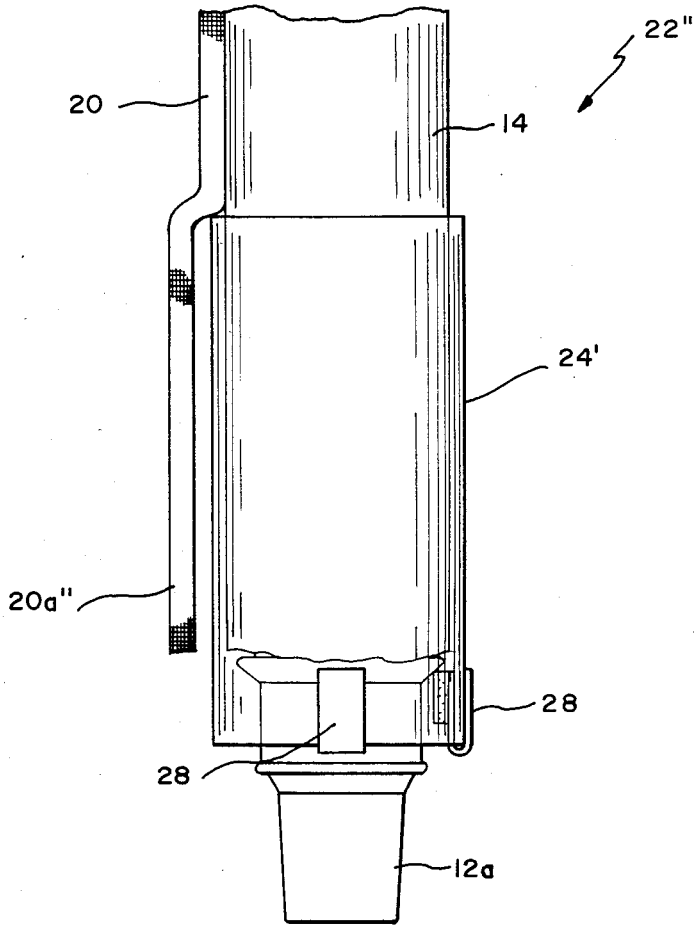
FIG. 8 is a side elevational view of still another modified storing and dispensing assembly.

Referring now to FIG. 8, attention is directed to still another assembly 22''. This latter assembly may be identical to assembly 22'' to the extent that it includes the same container 24' and associated clip members 28 and the same package 20. However, rather than folding back a section of ridge member 20 as in assembly 22', the same section of the ridge member is torn along its inner edge as seen in FIG. 8. This torn section indicated at **20*a*'' is not separated from body 14 but rather depends therefrom and drapes over the top edge of tube 24'. The juncture between this torn section and the non-torn section of member 20 serves to maintain the package in place, preventing it from pulling down into container 24' as cones are dispensed therefrom. In this regard, it is to be noted that the lowermost part of package 10 is torn to expose only the lowermost cone 12*a* rather than two or three cones as in FIGS. 3 and 6. This is preferred not only for assembly 22'' but also for assemblies 22 and 22'. With respect to assembly 22, previously described slot 32** would, of course, have to be sufficiently long to compensate for this modification.

All of the assemblies 22 and 22' and 22'' including package 10 were described in conjunction with ice cream cones **12*a***. In this regard, it is to be understood that this term, as used herein, is not only intended to encompass ice cream cones per se, but also other edible articles which are capable of nesting in one another to form a stack adapted to be stored and dispensed in the manner described (e.g. baked containers for chili, custard, soup or the like). Each of the assemblies including its specifically designed package is intended to maintain these edible articles as fresh and sterile as possible for as long as possible. As seen above, this is accomplished by the particular package design and dispensing technique disclosed herein wherein the package itself forms an integral part of the overall storage and dispensing assembly.

What is claimed is:

1. In an assembly for protectively storing and dispensing a stack of nested food items such as ice cream cones, cups and the like, an elongate self-contained dispensing package, said package being formed as an integral unit comprising an elongate vertical stack of nested food items substantially enclosed within a hollow enclosure formed of relatively stiff but compliant laminate material, said laminate material being joined along one elongate edge of said enclosure to form readily tearable integral ridge means extending the length of and projecting outward from said enclosure, a substantially cylindrical container having an open bottom end and forming part of said storage and dispensing assembly, said package and container cooperating with one another such that said extending ridge means is engageable within said container to maintain the packaging enclosure at a proper level for dispensing of said stacked food items, said readily tearable ridge means facilitating removal of a lower end section of said package so that the stacked food items can be easily dispensed through a lower end of said container.

2. An assembly according to claim 1 wherein said ridge means is folded back against said package enclosure so as to be wedged between the latter and the inner wall of said container.

3. An assembly according to claim 1 wherein said container includes an open top end and a slot extending from said top end toward said lower end of said container but stopping short thereof.

4. An assembly according to claim 1 wherein a portion of said ridge means is torn away from said package enclosure along its inner edge but not separated from said enclosure, said torn portion being adapted to extend over the non-dispensing edge of said container for maintaining said enclosure at a proper level for dispensing of said stacked food items.

5. An assembly according to claim 1 wherein said package includes an outer paper layer for providing stiffness and an inner plastic layer laminated to the paper layer and providing water resistance.

6. An assembly according to claim 1 wherein said container includes means for releasably retaining the lowermost one of said food items in said stack.

7. A method for forming a self-contained package for protectively transporting and dispensing stacked nested food items subject to moisture deterioration, contamination and/or staling, such as ice cream cones, cups and the like, comprising the steps of forming an elongate stack of nested food items, forming a section of a relatively stiff but compliant laminated material having dimensions to provide a surface area equivalent to but somewhat greater than a cylinder encompassing said stack of nested food items, said laminated material including an innermost layer of heat meltable plastic material, wrapping said laminated material about said stack of nested food items and simultaneously joining and sealing opposed, confronting edge sections thereof to form an elongate ridge member extending the length of and projecting outward from said stack of nested food items, and joining and sealing confronting edge sections of said laminated material extending outward from either end of said stack of nested food items to form ridge members at the ends of said self-contained protective package, said end ridge members extending in a plane normal to a plane including said elongate ridge member, said elongate ridge member being readily tearable to permit opening of an end of said self-contained package for exposure and dispensing of said stacked nested food items, each of the confronting edge sections forming each of the ridge members being joined by heat bonding together associated segments of said confronting sections.

* * * * *